US012397212B1

(12) United States Patent
Tan

(10) Patent No.: US 12,397,212 B1
(45) Date of Patent: Aug. 26, 2025

(54) BASKETBALL RETURN DEVICE

(71) Applicant: Jiahui Tan, Yangjing (CN)

(72) Inventor: Jiahui Tan, Yangjing (CN)

(73) Assignee: Yangjiang Jiali Sports Culture Development Co., Ltd., Yangjiang (CN)

( * ) Notice: Subject to any disclaimer, the term of this patent is extended or adjusted under 35 U.S.C. 154(b) by 0 days.

(21) Appl. No.: 19/173,842

(22) Filed: Apr. 9, 2025

(51) Int. Cl.
*A63B 63/08* (2006.01)
*A63B 63/00* (2006.01)
*A63B 69/00* (2006.01)

(52) U.S. Cl.
CPC ..... *A63B 63/083* (2013.01); *A63B 69/0071* (2013.01); *A63B 2063/001* (2013.01)

(58) Field of Classification Search
CPC ..... A63B 69/0071; A63B 63/083; A63B 2063/001; A63B 2210/50; A63B 2071/025
See application file for complete search history.

(56) References Cited

U.S. PATENT DOCUMENTS 4,579,339 A * 4/1986 Grimm ..... A63B 63/083 473/433
4,708,308 A * 11/1987 Snider ..... A47C 9/105 248/164
5,540,428 A * 7/1996 Joseph ..... A63B 63/083 473/433
5,558,323 A * 9/1996 LoFaso, Sr. ..... A63B 63/083 473/448
5,746,668 A * 5/1998 Ochs ..... A63B 63/083 473/433
5,803,837 A * 9/1998 LoFaso, Sr. ..... A63B 69/0071 473/448
8,012,046 B2 * 9/2011 Campbell ..... A63B 69/0071 473/433

(Continued)

FOREIGN PATENT DOCUMENTS

CN 206304334 U * 7/2017
CN 107050817 A * 8/2017 ..... A63B 69/0071

(Continued)

OTHER PUBLICATIONS

CN 107050817 A (Year: Aug. 2017).*

(Continued)

*Primary Examiner* — Eugene L Kim
*Assistant Examiner* — Amir A Klayman

(57) ABSTRACT

A basketball return device includes a mounting frame fixed to the basketball hoop support frame of a basketball stand via a mounting plate. A main frame fixedly connected to the mounting frame, and a movable plate of the main frame is slidably arranged on a fixing plate, and the fixing plate is provided with an opening for basketballs descent. A net-supporting rod whose mounting end is hinged to the movable plate. A flexible net detachably attached to the net-supporting rod, with the free end of the net-supporting rod supporting the flexible net to form an adjustable funnel-shaped guide structure that directs made basketballs toward the opening of the fixing plate. A basketball return mechanism, which is mounted on the main frame and provides multi-angle control of the basketball return direction through a rotating unit and a locking unit.

17 Claims, 9 Drawing Sheets

(56) References Cited

U.S. PATENT DOCUMENTS

| | | | | |
|---|---|---|---|---|
| 8,845,460 | B1 * | 9/2014 | Feldstein | A63B 69/0071 473/433 |
| 8,852,030 | B2 * | 10/2014 | Campbell | A63B 69/0071 473/433 |
| 9,227,125 | B2 * | 1/2016 | Le | A63B 63/083 |
| 10,330,247 | B2 * | 6/2019 | Shimodaira | F16M 11/38 |
| D991,379 | S * | 7/2023 | Lin | D21/720 |
| 11,904,219 | B1 * | 2/2024 | Hillary | A63B 69/0071 |
| 2004/0162165 | A1 * | 8/2004 | Tien | A63B 63/083 473/479 |
| 2009/0203472 | A1 * | 8/2009 | Snyder | A63B 63/083 473/433 |
| 2010/0210379 | A1 * | 8/2010 | Shelley | A63B 63/083 473/433 |
| 2012/0142454 | A1 * | 6/2012 | Campbell | A63B 47/02 473/422 |
| 2015/0051023 | A1 * | 2/2015 | Aipperspach | A63B 69/0071 473/433 |
| 2022/0249896 | A1 * | 8/2022 | Zhu | A63B 23/16 |
| 2023/0415016 | A1 * | 12/2023 | Wellington | A63B 69/0071 |

FOREIGN PATENT DOCUMENTS

| | | | | |
|---|---|---|---|---|
| CN | 207493167 | U | * | 6/2018 |
| CN | 213965094 | U | * | 8/2021 |
| JP | 2022027187 | A | * | 2/2022 |

OTHER PUBLICATIONS

CN 206304334 U (Year: Jul. 2017).*
CN 213965094 U (Year: Aug. 2021).*
JP 2022027187 A (Year: Feb. 2022).*
CN 207493167 U (Year: Jun. 2018).*

* cited by examiner

BASKETBALL RETURN DEVICE

TECHNICAL FIELD

The present disclosure relates to the technical field of sports equipment, and in particular, to basketball return device mounted on a basketball stand, configured to automatically collect basketballs after shooting and return them to the shooter's hands.

BACKGROUND OF THE INVENTION

In basketball training and competition scenarios, rapid ball retrieval and precise return after shooting are recognized as core technical requirements for enhancing training efficacy and competition smoothness. In professional basketball training, an athlete executes 5-8 shots per minute during high-intensity drills. With the traditional manual ball retrieval method, the interval between single shots exceeds 20 seconds, significantly reducing training density. NBA training statistics demonstrate that the basketball return device improves training efficiency by over 40%, with measurable reduction in training cycles.

Conventional basketball return devices typically include a frame structure mounted to a basketball hoop support frame through mounting plates, employing flexible nets to direct basketballs toward a collection port. However, these devices have the problem that the angles of the net-supporting rods are non-adjustable during both installation and operational use.

Therefore, the present disclosure provides a basketball return device, which can effectively solve the above problems.

SUMMARY OF THE INVENTION

The technical solution adopted by the present invention to solve the technical problem is as follows.

A basketball return device, configured to collect thrown basketballs towards a basketball stand and return the basketballs to a shooter, which includes a mounting frame, a main frame, a net-supporting rod, a flexible net and a basketball return mechanism.

The mounting frame includes a mounting plate, and the mounting plate is adapted to be mounted to a basketball hoop support frame of the basketball stand.

The main frame is fixedly connected to the mounting frame, the main frame includes a fixing plate and a movable plate, the fixing plate is fixedly connected to the main frame, the movable plate is slidably connected to the main frame, the fixing plate is provided with a fixing plate opening, and the fixing plate opening is configured to allow a thrown basketball to pass through and descend.

The net-supporting rod includes a free end and a mounting end, the mounting end is rotatably connected to the movable plate, and when the movable plate moves on the main frame, the net-supporting rod moves synchronously and rotates relative to the movable plate simultaneously.

The flexible net is detachably attached to the net-supporting rod and is configured to guide a made basketball towards the opening of the fixing plate.

The basketball return mechanism is mounted on the main frame and is configured to directly return the thrown basketball to the shooter.

As an improvement of the present invention, the fixing plate is provided with a receiving hole, the fixing plate is located above the movable plate; the mounting end passes through the receiving hole and is rotatably connected to the movable plate.

As an improvement of the present invention, the main frame includes a sliding rail, the movable plate includes a mounting portion, the mounting portion is slidably connected to the sliding rail, thereby enabling the movable plate to be slidably connected to the main frame.

As an improvement of the present invention, the sliding rail is provided with a plurality of fixing holes and a plurality of fixing pins, the fixing pins are removably secured in the fixing holes; the mounting portion is provided with positioning holes; when the fixing holes are aligned with the positioning holes, the movable plate is fixed to the main frame via the fixing pins; when the movable plate is fixed to the main frame, the net-supporting rod abuts against the fixing plate that defines the receiving hole; and the flexible net forms an upwardly and downwardly opening funnel shape around the net-supporting rod to guide the thrown basketball towards the fixing plate opening.

As an improvement of the present invention, the mounting end is provided with a mounting base hole, the movable plate is provided with a mounting base and a mounting pin, the mounting pin is detachably connected to the mounting base, and when the mounting pin passes through the mounting base hole and is connected to the mounting base, the mounting end is rotatably connected to the movable plate.

As an improvement of the present invention, when the positioning holes are secured at different fixing holes, an included angle θ formed between the net-supporting rod and a horizontal plane is adjustable, thereby varying an aperture size of an upward opening formed by the flexible net around the net-supporting rod, and the included angle θ is an acute angle.

As an improvement of the present invention, the fixing plate is further provided with a mounting hole, the flexible net is provided with a plurality of mounting straps and a plurality of mounting sleeves; the mounting sleeves are removably sleeved over the free end, and at least a part of the mounting straps are detachably secured in the mounting hole.

As an improvement of the present invention, the basketball return device is adapted to interchangeably receive the flexible nets of multiple specifications.

As an improvement of the present invention, the net-supporting rod is a telescopic rod.

As an improvement of the present invention, the basketball return device further includes a connecting element, the mounting frame and the main frame are fixedly connected via the connecting element.

As an improvement of the present invention, the connecting element is a metal plate, the connecting element is formed through bending operations and other metalworking processes into a configuration suitable for connecting the mounting frame and the main frame, and the mounting frame is fixedly connected to the main frame by welding and other fastening means.

As an improvement of the present invention, the main frame is further provided with moving wheels, the mounting plate is provided with a gripping opening, the gripping opening is configured to allow a palm to pass through and grip the mounting plate.

As an improvement of the present invention, the main frame further includes a base frame, and the base frame is configured to support the basketball return device in a substantially vertical orientation relative to ground.

As an improvement of the present invention, the mounting plate is provided with a basketball hoop cushion, and the basketball hoop cushion is configured to abut against a basketball hoop when the basketball return device is mounted on the basketball hoop support frame.

As an improvement of the present invention, the mounting frame is provided with a backboard cushion, and the backboard cushion is configured to abut against a backboard when the basketball return device is mounted on the basketball hoop support frame.

As an improvement of the present invention, the basketball return device further includes an auxiliary support element, the auxiliary support element is detachably connected to the main frame, and when the auxiliary support element is connected to the main frame, the auxiliary support element is adapted to engage with a basketball stand support pole to enhance stability of the basketball return device mounted on the basketball hoop support frame of the basketball stand.

As an improvement of the present invention, the basketball return mechanism includes a locking unit, a fixing unit and a rotating unit; the fixing unit is configured to connect the basketball return mechanism to the main frame, the rotating unit is rotatably connected to the fixing unit, the rotating unit is configured to guide a return direction of the thrown basketball, and the locking unit is configured to lock the rotating unit along its rotational path; when the locking unit is in a locked state, the rotating unit cannot rotate relative to the fixing unit; and when the locking unit is in an unlocked state, the rotating unit can rotate relative to the fixing unit.

As an improvement of the present invention, the basketball hoop cushion is slidably adjustable in a horizontal direction.

As an improvement of the present invention, the backboard cushion is slidably adjustable in a vertical direction.

As an improvement of the present invention, the auxiliary support element includes an auxiliary support rod and a conforming support portion, the auxiliary support rod is fixedly connected to the conforming support portion, a rope passage hole is provided at an end of the conforming support portion, and the conforming support portion exhibits elastic deformability.

By the arrangement of the above structure, during use, the linkage design of the movable plate and the net-supporting rod is configured to enable the sliding of the movable plate on the main frame to drive the net-supporting rod to move synchronously and rotate around the mounting end. Therefore, the angle of the net-supporting rod can be adjusted based on different shooting training requirements, and further adjusts the position and angle of the funnel-shaped guiding structure jointly formed with the flexible net. This greatly improves the adaptability of the device to different shooting situations and ensures that the basketball can smoothly enter the return system. The basketball return mechanism can quickly return the basketball to the shooter, reducing the time for the shooter to pick up the basketball, allowing the shooter to focus more on the training, and improving the training efficiency. Through this structural configuration, the angle adjustability of the net-supporting rod enables precise control of basketball return trajectories while enhancing installation compatibility and stability. The device accommodates both competitive training and amateur applications. The flexible net is secured via detachable sleeve bags and mounting straps, allowing rapid replacement or upgrades to different-sized net assemblies.

BRIEF DESCRIPTION OF DRAWINGS

In order to explain the technical solutions of the embodiments of the present invention more clearly, the following will briefly introduce the accompanying drawings used in the embodiments. The drawings in the following description are only some embodiments of the present invention. Those of ordinary skill in the art can obtain other drawings based on these drawings without creative work. In addition, the accompanying drawings are not drawn to a scale of 1:1, and the relative dimensions of the various elements are only shown as examples in the diagrams, not necessarily drawn to a true scale.

The present invention is further described below in detail in combination with the accompanying drawings and embodiments.

DETAILED DESCRIPTION OF THE INVENTION

Figure 1:
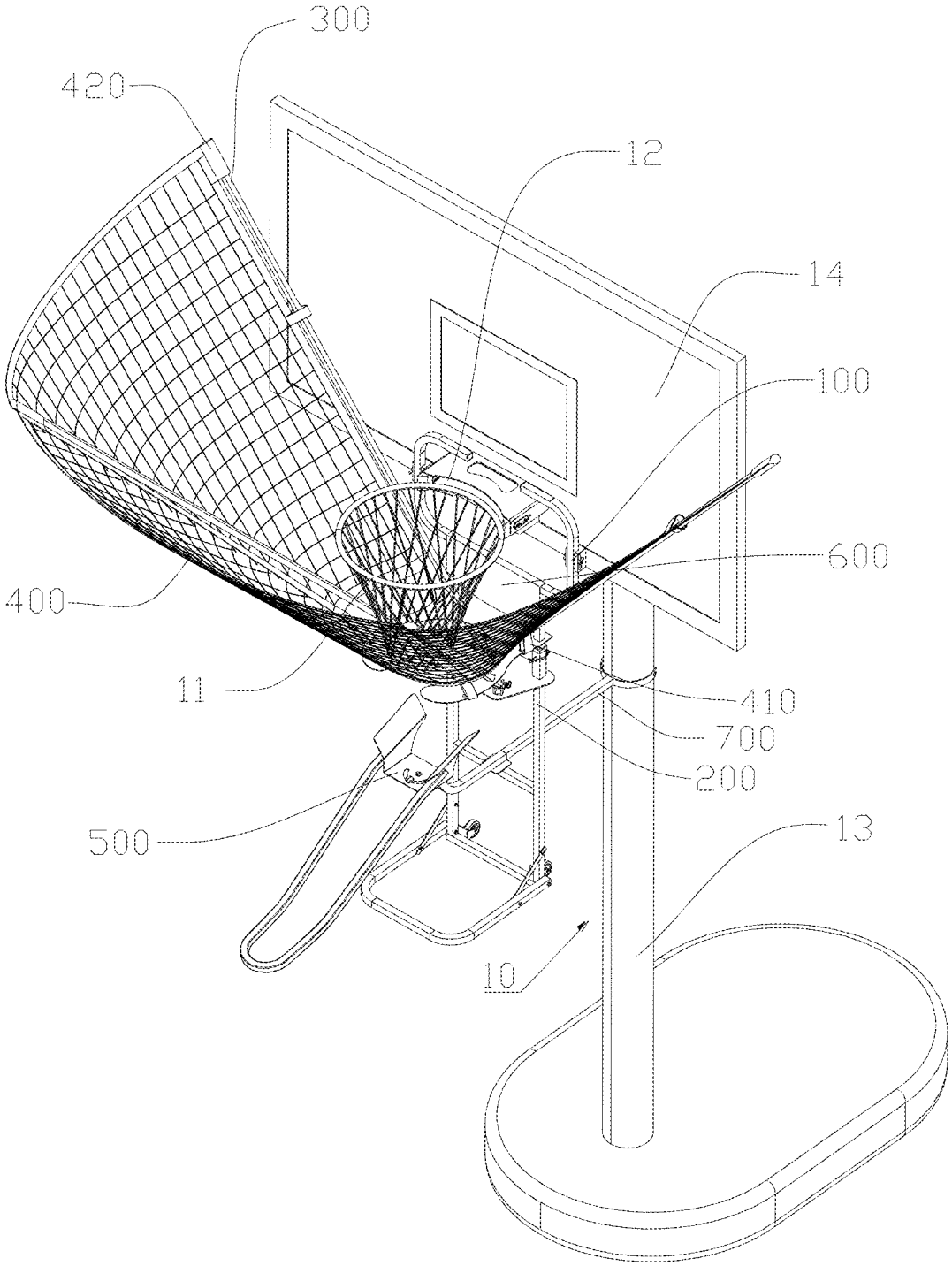
FIG. 1 is a schematic diagram of an overall structure of a basketball return device from a first angle, mounted on a basketball stand 10 according to the present disclosure.

To make the aforementioned objectives, features, and advantages of the present disclosure more comprehensible, specific implementations of the present disclosure are described in detail below in conjunction with the accompanying drawings. In the following description, numerous specific details are set forth to provide a thorough understanding of the present disclosure. The present disclosure may, however, be embodied in many forms different from that described here. A person skilled in the art can make similar improvements without departing from the connotation of the present disclosure. Therefore, the present disclosure is not limited by the specific embodiments disclosed below.

To make the aforementioned objectives, features, and advantages of the present invention more comprehensible, specific implementations of the present invention are described in detail below in conjunction with the accompanying drawings. In the following description, numerous specific details are set forth to provide a thorough understanding of the present invention. The present invention may, however, be embodied in many forms different from that described here. A person skilled in the art can make similar improvements without departing from the connotation of the present invention. Therefore, the present invention is not limited by the specific embodiments disclosed below.

In the description of the present invention, It is to be understood that, The terms "center", "longitudinal", "transverse", "upper", "lower", "front", "rear", "left", "right", "vertical", "horizontal", "top", "bottom", "inner", "outer", "clockwise", "counterclockwise", and the like indicate azimuth or positional relationships based on the azimuth or positional relationships shown in the drawings, For purposes of convenience only of describing the present invention and simplifying the description, Rather than indicating or implying that the indicated device or element must have a particular orientation, be constructed and operated in a particular orientation, therefore, not to be construed as limiting the present invention.

In addition, the terms "first" and "second" are used for descriptive purposes only, while not to be construed as indicating or implying relative importance or implicitly specifying the number of technical features indicated thereby, features defining "first," "second," and "second" may explicitly or implicitly include one or more of the described features. In the description of the present invention, "multiple" means two or more unless explicitly specified otherwise.

In addition, the terms "install", "arrange", "provide", "connect" and "couple" should be understood broadly. For example, it can be a fixed connection, a detachable connection, an integral structure, a mechanical connection, an electrical connection, a direct connection, an indirect connection through an intermediate medium, or a communication between two devices, elements or components. For ordinary technical personnel in this field, the specific meanings of the above terms in present invention can be understood based on specific circumstances.

In the present invention, unless specific regulation and limitation otherwise, the first feature "onto" or "under" the second feature may include the direct contact of the first feature and the second feature, or may include the contact of the first feature and the second feature through other features between them instead of direct contact. Moreover, the first feature "onto", "above" and "on" the second feature includes that the first feature is right above and obliquely above the second feature, or merely indicates that the horizontal height of the first feature is higher than the second feature. The first feature "under", "below" and "down" the second feature includes that the first feature is right above and obliquely above the second feature, or merely indicates that the horizontal height of the first feature is less than the second feature.

It should be noted that when an element is referred to as being "fixed to" another element, the element can be directly on another component or there can be a centered element. When an element is considered to be "connected" to another element, the element can be directly connected to another element or there may be a centered element. The terms "inner", "outer", "left", "right", and similar expressions used herein are for illustrative purposes only and do not necessarily represent the only implementation.

Figure 2:
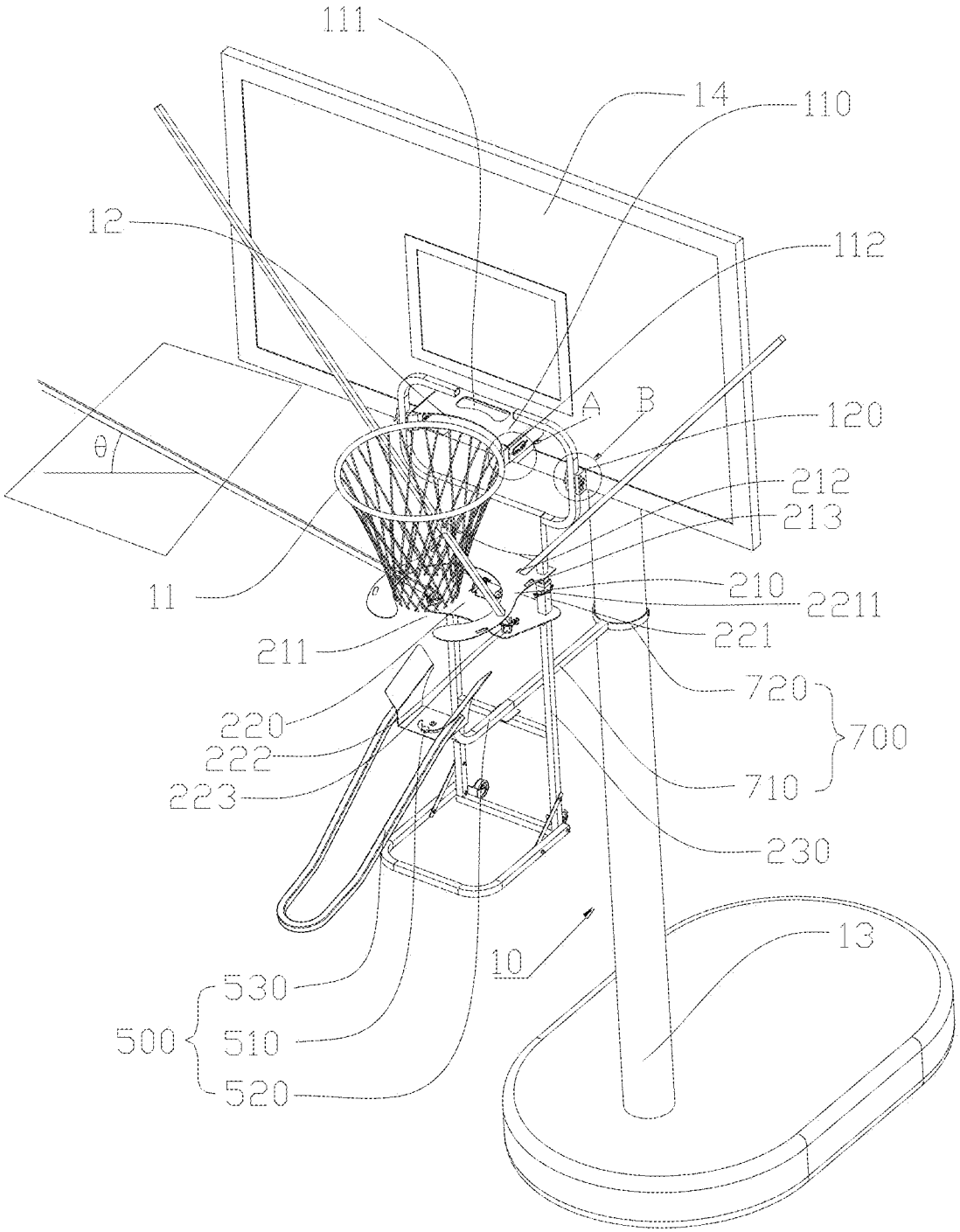
FIG. 2 is a schematic diagram of an overall structure of the basketball return device from the first angle, mounted on the basketball stand 10 after removing a flexible net 400 according to the present disclosure.
Figure 3:
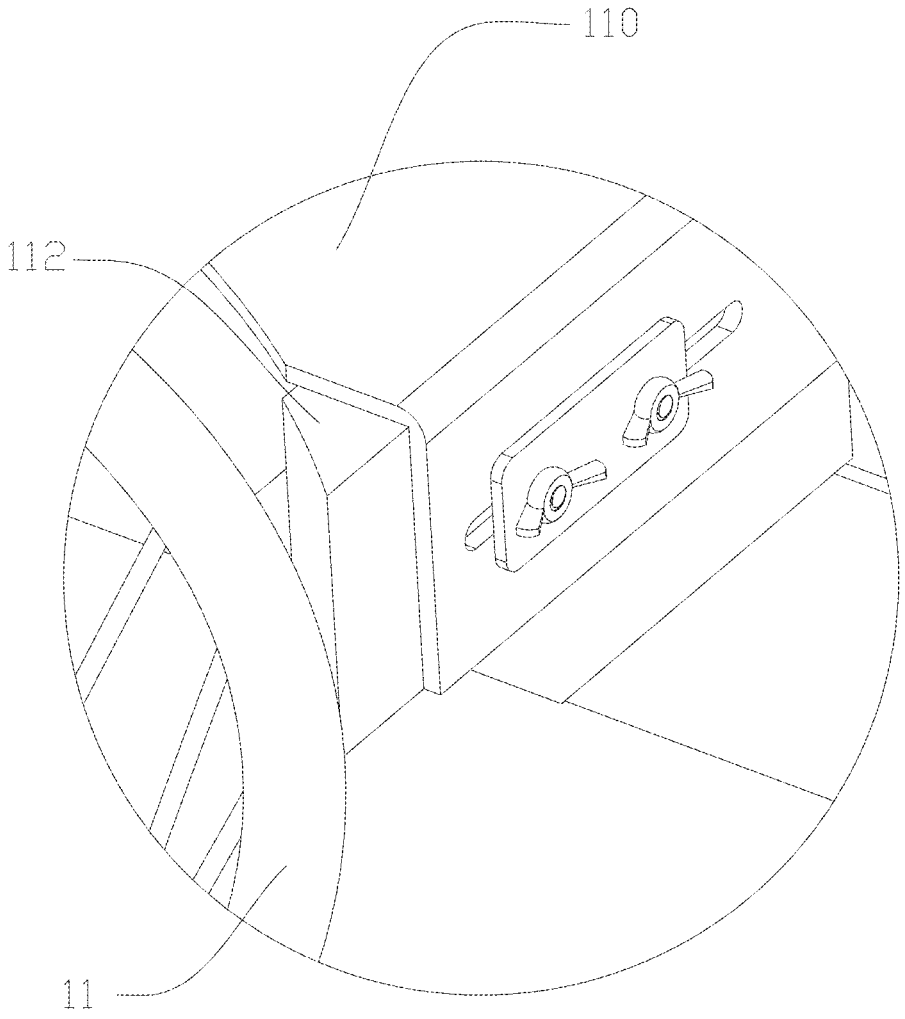
FIG. 3 is an enlarged diagram of an area circled as A in FIG. 2.
Figure 4:
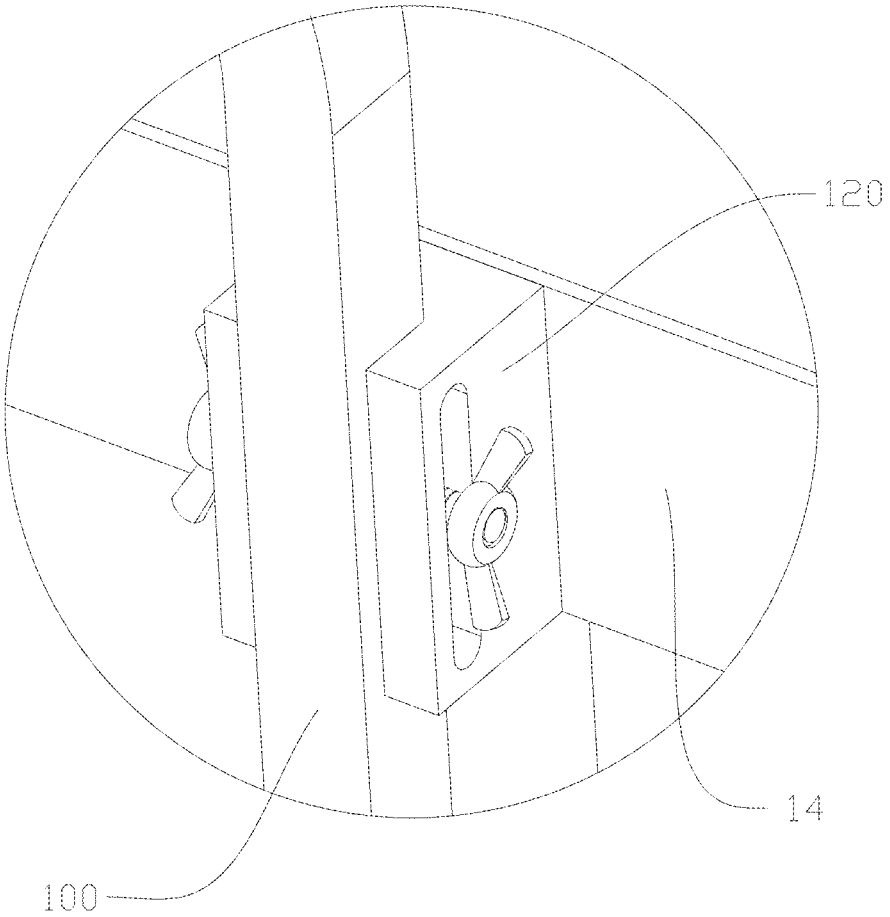
FIG. 4 is an enlarged diagram of an area circled as B in FIG. 2.
Figure 5:
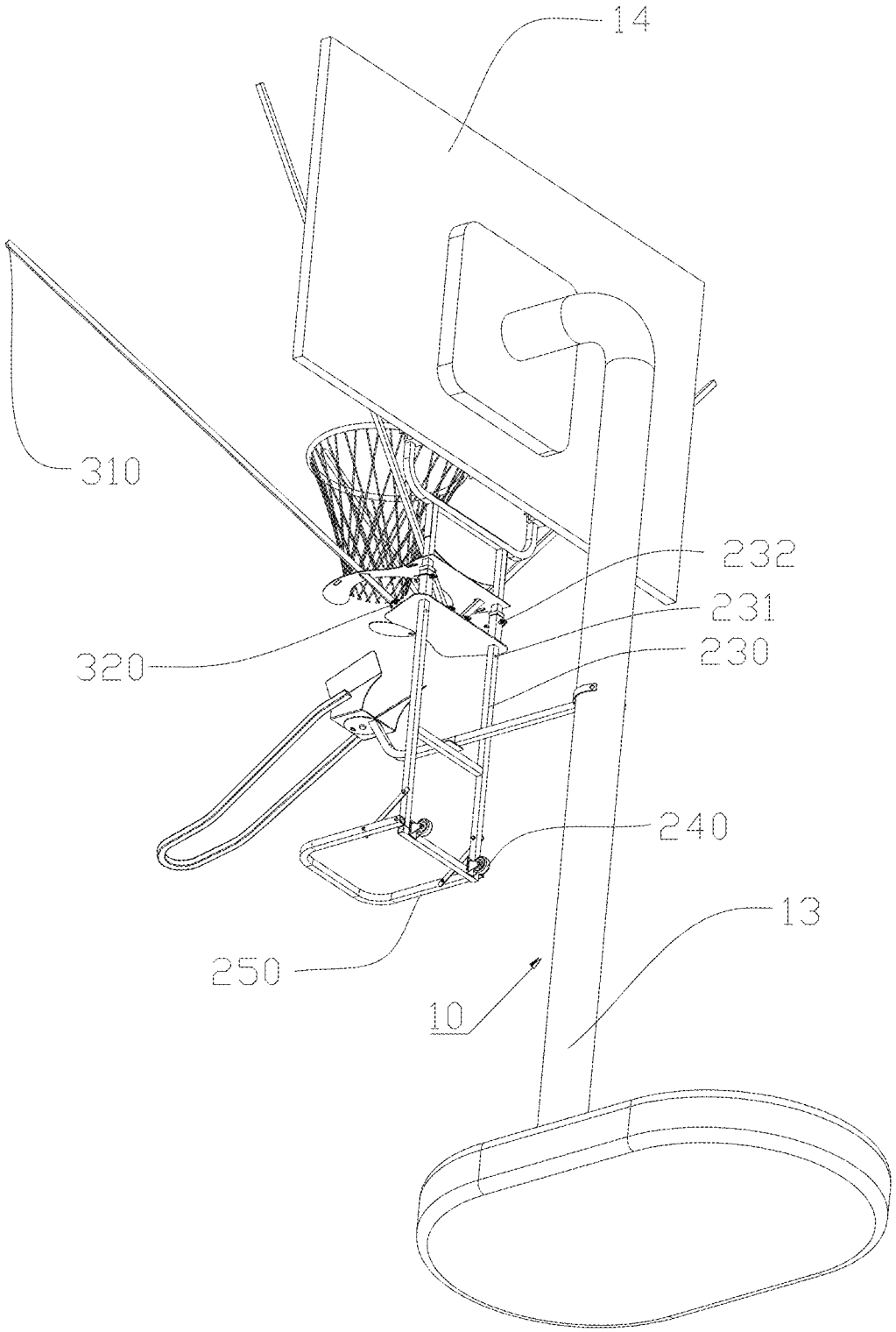
FIG. 5 is a schematic diagram of an overall structure of the basketball return device from a second angle, mounted on the basketball stand 10 after removing the flexible net 400 according to the present disclosure.
Figure 6:
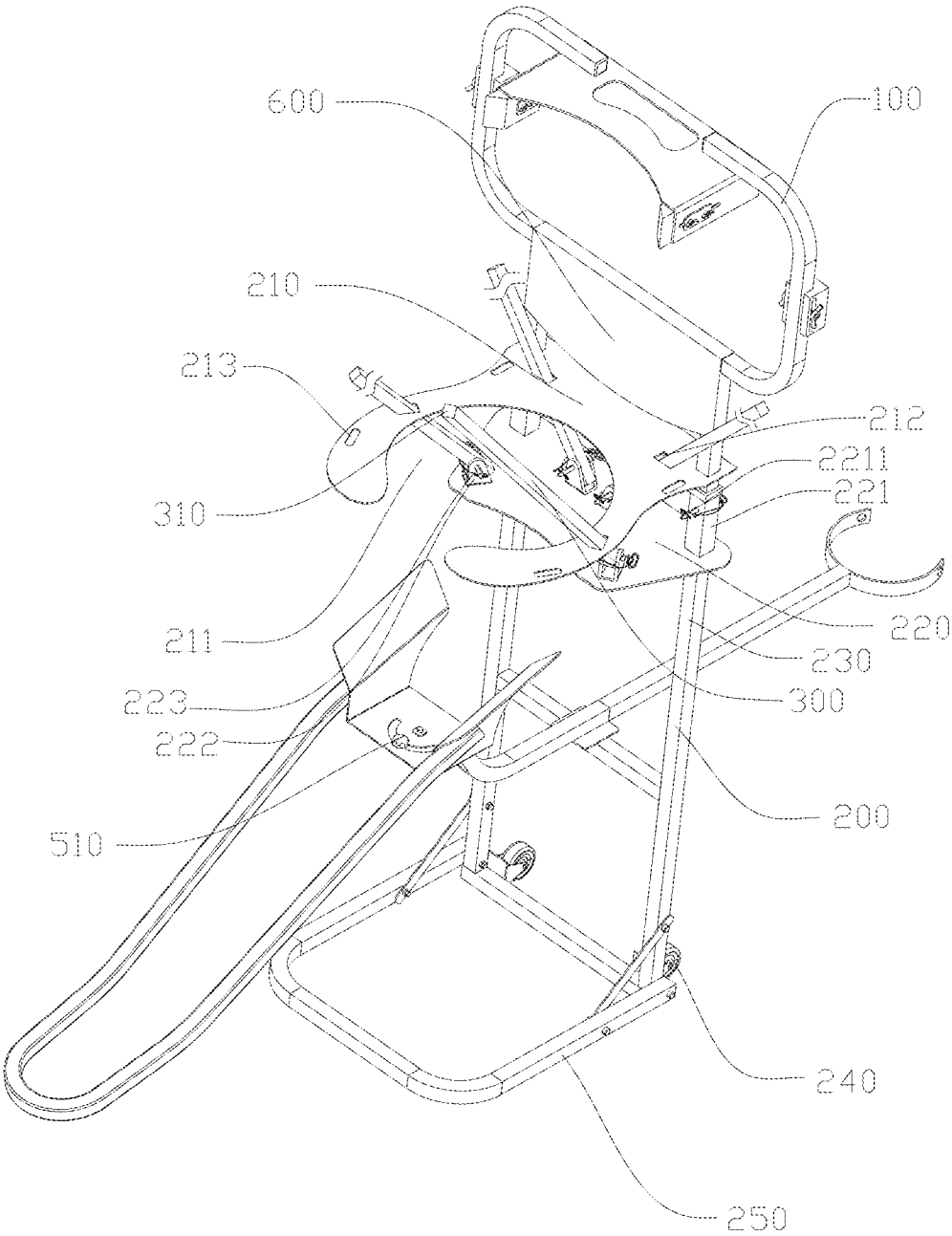
FIG. 6 is a schematic diagram of an overall structure of the basketball return device in a first state according to the present disclosure.
Figure 7:
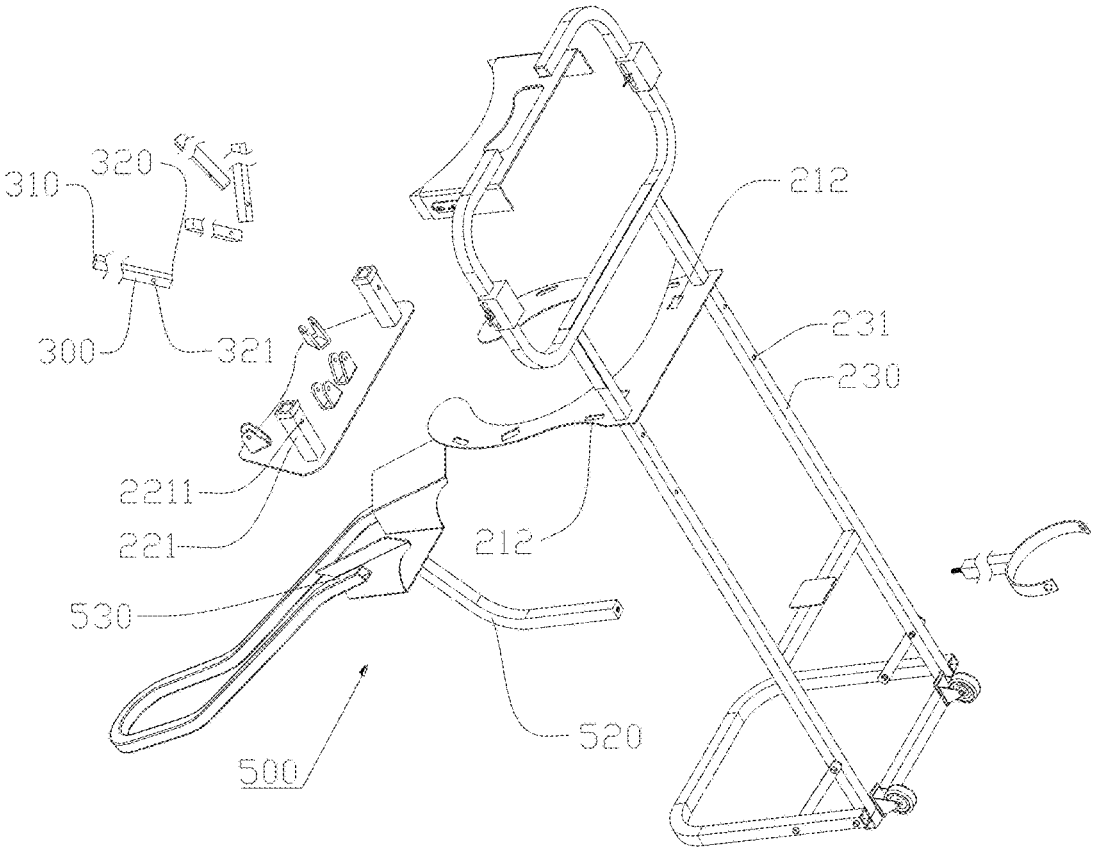
FIG. 7 is a schematic diagram of an exploded structure of the basketball return device according to the present disclosure.
Figure 8:
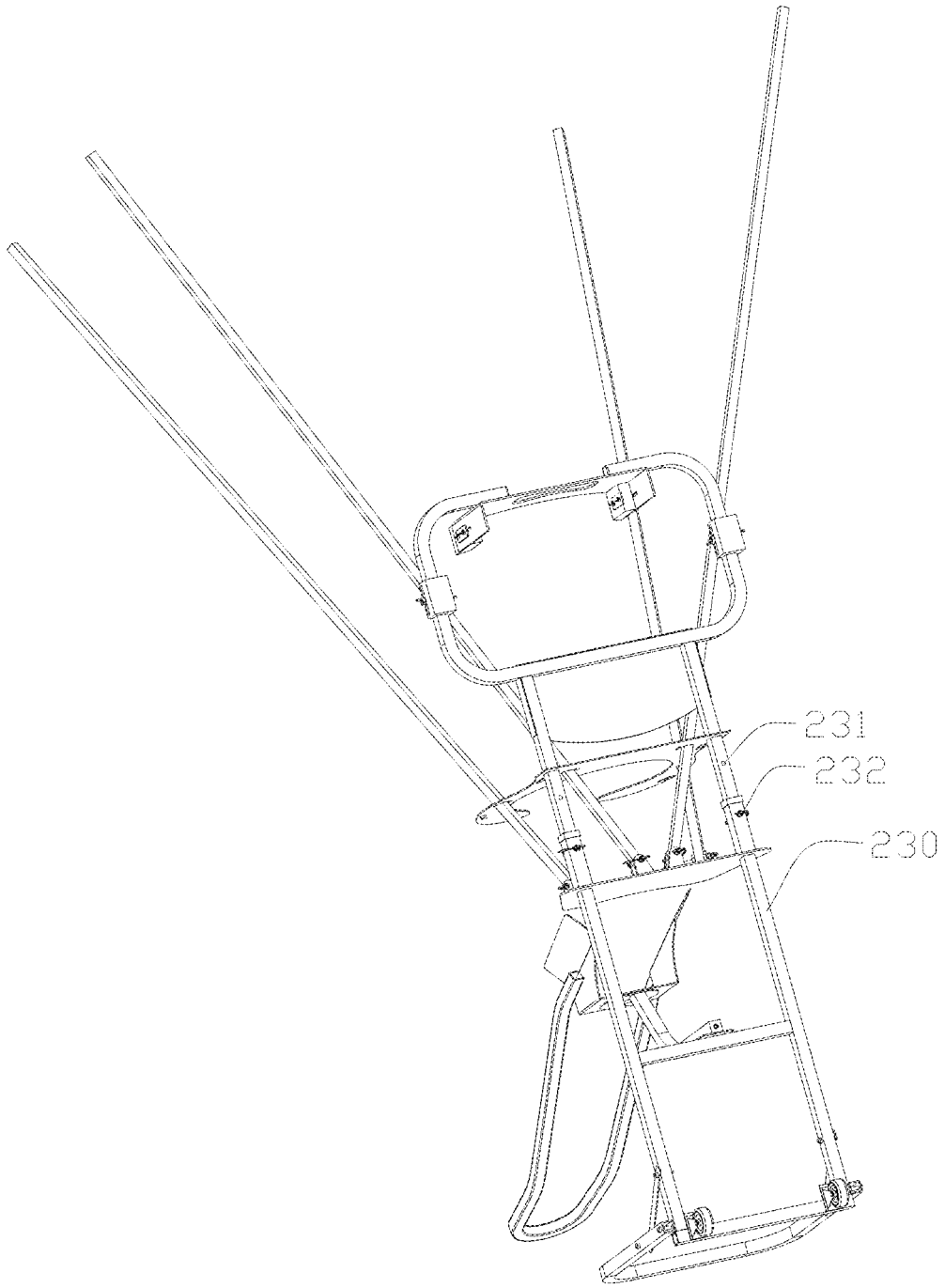
FIG. 8 is a schematic diagram of an overall structure of the basketball return device in a second state according to the present disclosure.
Figure 9:
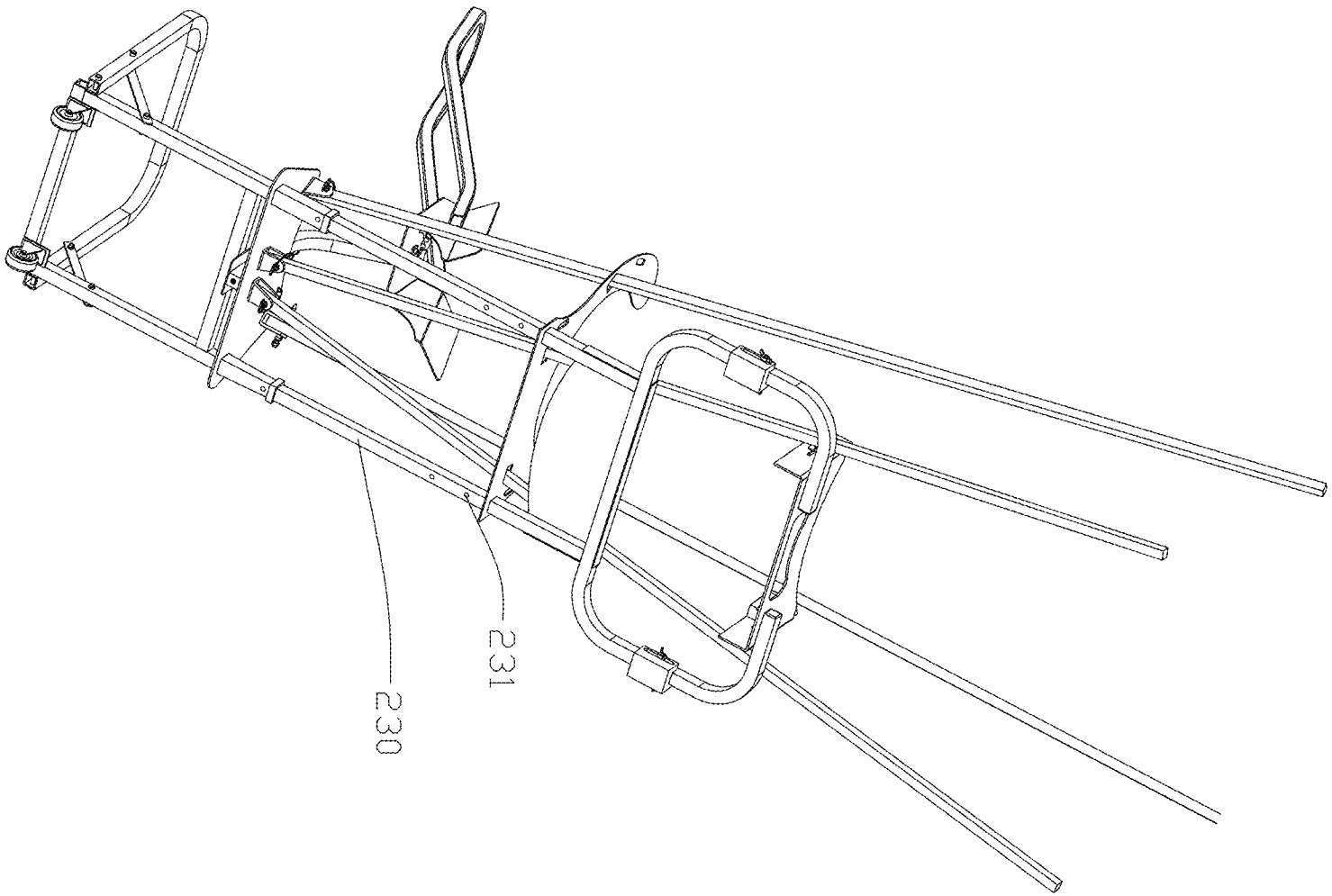
FIG. 9 is a schematic diagram of an overall structure of the basketball return device in a third state according to the present disclosure.

Referring to FIG. 1 to FIG. 9, a basketball return device is configured to collect thrown basketballs towards a basketball stand 10 and return the basketballs to a shooter, which includes a mounting frame 100, a main frame 200, a net-supporting rod 300, a flexible net 400 and a basketball return mechanism 500.

The mounting frame 100 includes a mounting plate 110, and the mounting plate 110 is adapted to be mounted to a basketball hoop support frame 12 of the basketball stand 10.

The main frame 200 is fixedly connected to the mounting frame 100, the main frame 200 includes a fixing plate 210 and a movable plate 220, the fixing plate 210 is fixedly connected to the main frame 200, the movable plate 220 is slidably connected to the main frame 200, the fixing plate 210 is provided with a fixing plate opening 211, and the fixing plate opening 211 is configured to allow a thrown basketball to pass through and descend.

The net-supporting rod 300 includes a free end 310 and a mounting end 320, the mounting end 320 is rotatably connected to the movable plate 220, and when the movable plate 220 moves on the main frame 200, the net-supporting rod 300 moves synchronously and rotates relative to the movable plate 220 simultaneously.

The flexible net 400 is detachably attached to the net-supporting rod 300 and is configured to guide a made basketball towards the opening of the fixing plate; and The basketball return mechanism 500 is mounted on the main frame 200 and is configured to directly return the thrown basketball to the shooter.

By the arrangement of the above structure, during use, the linkage design of the movable plate 220 and the net-supporting rod 300 is configured to enable the sliding of the movable plate 220 on the main frame 200 to drive the net-supporting rod 300 to move synchronously and rotate around the mounting end 320. Therefore, the angle of the net-supporting rod 300 can be adjusted based on different shooting training requirements, and further adjusts the position and angle of the funnel-shaped guiding structure jointly formed with the flexible net 400. This greatly improves the adaptability of the device to different shooting situations and ensures that the basketball can smoothly enter the return system. The basketball return mechanism 500 can quickly return the basketball to the shooter, reducing the time for the shooter to pick up the basketball, allowing the shooter to focus more on the training, and improving the training efficiency.

In this embodiment, the fixing plate 210 is provided with a receiving hole 212, and the fixing plate 210 is located above the movable plate 220; the mounting end 320 passes through the receiving hole 212 and is rotatably connected to the movable plate 220. By the arrangement of the above structure, during use, although the net-supporting rod 300 has a certain degree of freedom of movement, due to the restriction of the receiving hole 212 provided on the fixing plate 210 and the reliable connection between the mounting end 320 and the movable plate 220, the net-supporting rod 300 and the flexible net 400 can maintain a stable working state, preventing excessive shaking or loosening and ensuring the reliability and service life of the device.

In this embodiment, the main frame 200 includes a sliding rail 230, the movable plate 220 includes a mounting portion 221, the mounting portion 221 is slidably connected to the sliding rail 230, thereby enabling the movable plate 220 to be slidably connected to the main frame 200. By the arrangement of the above structure, during use, through the sliding cooperation between the mounting portion 221 and the sliding rail 230, the movable plate 220 slides on the main frame 200. This sliding function permits the movable plate 220 to adjust its position on the main frame 200 based on actual needs, and then drives the components such as the net-supporting rod 300 and the flexible net 400 connected to the movable plate 220 to undergo corresponding positional changes, providing flexible adjustment capability for the whole basketball return device to adapt to various shooting situations.

In this embodiment, the sliding rail 230 is provided with a plurality of fixing holes 231 and a plurality of fixing pins 232, the fixing pins 232 are removably secured in the fixing holes 231. The mounting portion 221 is provided with positioning holes 2211. When the fixing holes 231 are aligned with the positioning holes 2211, the movable plate 220 is fixed to the main frame 200 via the fixing pins 232. When the movable plate 220 is fixed to the main frame 200, the net-supporting rod 300 abuts against the fixing plate 210 that defines the receiving hole 212; and the flexible net 400 forms an upwardly and downwardly opening funnel shape around the net-supporting rod 300 to guide the thrown basketball towards the fixing plate opening 211. By the arrangement of the above structure, during use, the arrangement of multiple fixing holes 231 enables the movable plate 220 to be fixed at multiple precise positions, meeting the fine-tuning requirements in different usage scenarios. Users can adjust the movable plate 220 to the most suitable position according to the actual situation, thereby optimizing the angle and position of the flexible net 400 and improving the device's effectiveness in collecting basketballs. The detachable design of the fixing pins 232 makes the fixing and adjustment operations of the movable plate 220 very simple. Users need only manually insert or extract the fixing pins 232 without professional tools to complete the position adjustment and fixing of the movable plate 220, reducing the usage threshold and enhancing the device's ease of use. When the movable plate 220 is fixed, the net-supporting rod 300 abuts against the fixing plate 210. This structural design enhances the stability of the entire device. The abutment between the net-supporting rod 300 and the fixing plate 210, together with the funnel-shaped structure formed by the flexible net 400, enables the device to withstand substantial impact forces when receiving basketballs, ensuring the reliability and safety of the device during use.

In this embodiment, the mounting end 320 is provided with a mounting base hole 321, the movable plate 220 is provided with a mounting base 222 and a mounting pin 223, the mounting pin 223 is detachably connected to the mounting base 222. When the mounting pin 223 passes through the mounting base hole 321 and is connected to the mounting base 222, the mounting end 320 is rotatably connected to the movable plate 220. By the arrangement of the above structure, when the basketball return device is not in use, the detachable design of the mounting pin 223 makes the maintenance of the device and the replacement of its components more convenient. If the net-supporting rod 300 is damaged or needs to be upgraded, the mounting pin 223 can be easily removed to separate the mounting end 320 from the movable plate 220, enabling the replacement or repair of the corresponding components, reducing the maintenance cost and difficulty. This connection structure reflects the concept of modular design. Each component (the mounting end 320, the mounting base 222, and the mounting pin 223) is relatively independent, which facilitates production, assembly, and debugging. Different components can be optimized and improved separately without affecting the functions of other parts, thus improving the design and production efficiency of the product.

In this embodiment, when the positioning holes 2211 are secured at different fixing holes 231, an included angle θ formed between the net-supporting rod 300 and a horizontal plane is adjustable, thereby varying an aperture size of the upward opening formed by the flexible net 400 around the net-supporting rod 300, and the included angle θ is an acute angle. By the arrangement of the above structure, during use, the basketball return device can accommodate diverse shooters' needs, enhancing the device's versatility. Whether in schools, gymnasiums, or other basketball venues, by adjusting the parameters of the device, it can operate optimally while satisfying usage requirements of different users.

In this embodiment, the fixing plate 210 is further provided with a mounting hole 213, the flexible net 400 is provided with a plurality of mounting straps 410 and a plurality of mounting sleeves 420; the mounting sleeves 420 are removably sleeved over the free end 310, and at least a part of the mounting straps 410 are detachably secured in the mounting hole 213. By the arrangement of the above structure, during use, the detachable connection mode of the mounting straps 410 and the mounting sleeves 420 makes the installation process of the flexible net 400 simple and quick, requiring neither professional tools nor complex operations. Users can easily mount or remove the flexible net 400 according to their needs, improving the convenience of using the device. The detachable installation design also reduces the maintenance cost of the flexible net 400. When the flexible net 400 is damaged, only the flexible net 400 itself needs to be replaced, eliminating the need for large-scale disassembly and replacement of the entire device. This reduces the maintenance time and cost, and improves the service life and economic efficiency of the device.

In this embodiment, the basketball return device is adapted to interchangeably receive the flexible nets 400 of multiple specifications. By the arrangement of the above structure, during use, the basketball return device achieves enhanced flexibility and scalability. Users can replace the flexible nets 400 of different specifications at any time based on the actual situation without replacing the entire return device.

In this embodiment, the net-supporting rod 300 is a telescopic rod. By the arrangement of the above structure, during use, the telescopic rod is configured to adjust its length flexibly based on practical demands, thereby altering the height of the net-supporting rod 300.

In this embodiment, the device further includes a connecting element 600, the mounting frame 100 and the main frame 200 are fixedly connected via the connecting element 600. The connecting element 600 is a metal plate, the metal plate is formed through bending and other metalworking processes to a configuration suitable for connecting the mounting frame 100 and the main frame 200, and with the mounting frame 100 being fixedly attached to the main frame 200 via welding or other fastening methods. By the arrangement of the above structure, during use, the main function of the connecting element 600 is to firmly connect the mounting frame 100 and the main frame 200 together, forming a stable overall structure. During use of the basketball return device, it is subjected to external forces including basketball impact forces and gravitational loads. The connecting element 600 must bear these forces to prevent relative displacement or loosening between the frames, ensuring device stability and reliability. When a basketball impacts the flexible net 400, the impact force is transmitted through the net-supporting rod 300 and main frame 200 to the connecting element 600 and mounting frame 100. The connecting element 600 effectively disperses and withstands these forces. Practical tests demonstrate that with metal plate thickness exceeding 1.5 mm, performance is optimal. The high-strength metal plate, after bending and welding, provides robust connectivity between the mounting frame 100 and main frame 200. This high-strength connection can withstand significant external forces, extends service life, and reduces maintenance costs from connection part damage. Through bending processing technology, the connecting element 600 can be customized to the specific structures and connection requirements of the mounting frame 100 and main frame 200, enabling the design of complex shapes to adapt to various installation spaces and connection methods, improving overall design flexibility and adaptability.

In this embodiment, the main frame 200 is further provided with moving wheels 240, the mounting plate 110 is provided with a gripping opening 111, the gripping opening 111 is configured to allow a palm to pass through and grip the mounting plate 110. By the arrangement of the above structure, during use, the gripping opening 111 is provided on the mounting plate 110. Cooperating with the moving wheels 240 disposed on the main frame 200, this configuration enables more labor-saving and safer transportation of the basketball return device. When relocating the device, a user can pass their palm through the gripping opening 111 to securely grasp the mounting plate 110, thereby improving positional control while moving the device and enhancing user experience.

In this embodiment, the main frame 100 further includes a base frame 250, and the base frame 250 is configured to support the basketball return device in a substantially vertical orientation relative to ground. By the arrangement of the above structure, during use, when the assembled basketball return device requires temporary ground placement, it is configured to stand stably substantially vertically on the ground.

In this embodiment, the mounting plate 110 is provided with a basketball hoop cushion 112, and the basketball hoop cushion 112 is configured to abut against a basketball hoop 11 when the basketball return device is mounted on the basketball hoop support frame 12. By the arrangement of the above structure, when the basketball return device is mounted to the basketball hoop support frame 12, the basketball hoop cushion 112 provides buffering and protective functions. During the basketball gameplay, the device may experience external forces such as basketball impacts, potentially causing collisions and friction between the device and the basketball hoop 11. The basketball hoop cushion 112 absorbs these impact forces, mitigating direct collisions between the device and the basketball hoop. This protection mechanism prevents damage to both the basketball hoop 10 and the device itself, thereby extending their service lives.

In this embodiment, the mounting frame 110 is provided with a backboard cushion 120, and the backboard cushion 120 is configured to abut against the backboard 14 when the basketball return device is mounted on the basketball hoop support frame 12. By the arrangement of the above structure, during use, when the backboard cushion 120 abuts against the backboard 14, frictional forces are generated therebetween. This configuration enhances stability of the basketball return device in the installed state and reduces the shaking or displacement of the device caused by external forces (such as basketball impacts, accidental bumps by people, etc.) during use.

In this embodiment, the basketball return device further includes an auxiliary support element 700, and the auxiliary support element 700 is detachably connected to the main frame 200. When the auxiliary support element 700 is connected to the main frame 200, the auxiliary support element 700 is adapted to engage with a basketball stand support pole 13 to enhance stability of the basketball return device mounted on the basketball hoop support frame 12 of the basketball stand 10. By the arrangement of the above structure, during use, since the auxiliary support element 700 is detachably connected to the main frame 200, users can optionally mount it based on actual situations. In professional training scenarios requiring enhanced stability (e.g., competitive practice), mounting the element 700 can significantly reduce the shaking of the device during intensive use and improve its stability. For casual recreational use where easy setup is preferred, omitting the element 700 allows for faster deployment and storage of the device.

In this embodiment, the basketball return mechanism 500 includes a locking unit 510, a fixing unit 520 and a rotating unit 530; the fixing unit 520 is configured to connect the basketball return mechanism 500 to the main frame 200, the rotating unit 530 is rotatably connected to the fixing unit 520, the rotating unit 530 is configured to guide a return direction of the thrown basketball, and the locking unit 510 is configured to lock the rotating unit 530 along its rotational path; when the locking unit 510 is in a locked state, the rotating unit 530 cannot rotate relative to the fixing unit 520; and when the locking unit 510 is in an unlocked state, the rotating unit 530 can rotate relative to the fixing unit 520. By the arrangement of the above structure, during use, the basketball return mechanism 500 adapts to varied shooting positions, angles, and force intensities. The rotatable unit 530 and lockable unit 510 enable users to adjust return directions flexibly, improving adaptation to different shooting scenarios. Moreover, the rigid connection between the fixing unit 520 and the main frame 200, combined with the locking unit 510 securing the rotating unit 530 in the locked state, ensures stability during operation. Even under high-impact basketball strikes, the mechanism 500 maintains precise positioning for accurate returns, enhancing reliability. In addition, the locking unit 510 is designed for operational simplicity, allowing locking/unlocking for quick directional changes. This intuitive operation reduces user skill requirements while optimizing experience.

In this embodiment, the basketball hoop cushion 112 is slidably adjustable in a horizontal direction. The backboard cushion 120 is slidably adjustable in a vertical direction. By the arrangement of the above structure, during use, since the basketball hoop cushion 112 can be slidably adjusted in the horizontal direction, it can precisely adapt to different positions of the basketball hoop. As basketball hoops vary slightly in size, shape, or installation position, the horizontal sliding adjustment allows the basketball hoop cushion 112 to achieve optimal contact with the edge of the basketball hoop 11, ensuring that the basketball hoop cushion 112 can effectively provide buffering and protection after the installation of the basketball return device. This minimizes collisions and friction between the device and basketball hoop 11, preventing damage to both components.

In this embodiment, the auxiliary support element 700 includes an auxiliary support rod 710 and a conforming support portion 720. The auxiliary support rod 710 is fixedly connected to the conforming support portion 720. A rope passage hole is provided at the end of the conforming support portion 720, and the conforming support portion 720 exhibits elastic deformability. By the arrangement of the above structure, during use, the auxiliary support element 700 is detachably connected to the main frame 200 and cooperates with the main frame 200 to collectively enhance the stability of the basketball return device when mounted on the basketball stand 10. Since the conforming support portion 720 is provided with a rope passage hole at its end and has elastic properties, it can better conform to the basketball stand support pole 13. Notably, a flexible rope may be threaded through the rope passage hole to secure the end of the conforming support portion 720, enabling tighter surface contact with the basketball stand support pole 13.

As described above, one or more embodiments are provided in conjunction with the detailed description, The specific implementation of the present invention is not confirmed to be limited to that the description is similar to or similar to the method, the structure and the like of the present invention, or a plurality of technical deductions or substitutions are made on the premise of the conception of the present invention to be regarded as the protection of the present invention.

The invention claimed is:

1. A basketball return device, configured to collect thrown basketballs towards a basketball stand and return the basketballs to a shooter, comprising:

a mounting frame, wherein the mounting frame comprises a mounting plate, and the mounting plate is adapted to be mounted to a basketball hoop support frame of the basketball stand;

a main frame, wherein the main frame is fixedly connected to the mounting frame, the main frame comprises a fixing plate and a movable plate, the fixing plate is fixedly connected to the main frame, the movable plate is slidably connected to the main frame, the fixing plate is provided with a fixing plate opening, and the fixing plate opening is configured to allow a thrown basketball to pass through and descend;

a net-supporting rod, wherein the net-supporting rod comprises a free end and a mounting end, the mounting end is rotatably connected to the movable plate, and when the movable plate moves on the main frame, the net-supporting rod moves synchronously and rotates relative to the movable plate simultaneously;

a flexible net, wherein the flexible net is detachably attached to the net-supporting rod and is configured to guide a made basketball towards the opening of the fixing plate; and a basketball return mechanism, wherein the basketball return mechanism is mounted on the main frame and is configured to directly return the thrown basketball to the shooter.

2. The basketball return device according to claim 1, wherein the fixing plate is provided with a receiving hole, the fixing plate is located above the movable plate; the mounting end passes through the receiving hole and is rotatably connected to the movable plate.

3. The basketball return device according to claim 2, wherein the main frame comprises a sliding rail, the movable plate comprises a mounting portion, the mounting portion is slidably connected to the sliding rail, thereby enabling the movable plate to be slidably connected to the main frame.

4. The basketball return device according to claim 3, wherein the sliding rail is provided with a plurality of fixing holes and a plurality of fixing pins, the fixing pins are removably secured in the fixing holes; the mounting portion is provided with positioning holes; when the fixing holes are aligned with the positioning holes, the movable plate is fixed to the main frame via the fixing pins; when the movable plate is fixed to the main frame, the net-supporting rod abuts against the fixing plate that defines the receiving hole; and the flexible net forms an upwardly and downwardly opening funnel shape around the net-supporting rod to guide the thrown basketball towards the fixing plate opening.

5. The basketball return device according to claim 2, wherein the mounting end is provided with a mounting base hole, the movable plate is provided with a mounting base and a mounting pin, the mounting pin is detachably connected to the mounting base, and when the mounting pin passes through the mounting base hole and is connected to the mounting base, the mounting end is rotatably connected to the movable plate.

6. The basketball return device according to claim 4, wherein when the positioning holes are secured at different fixing holes, an included angle θ formed between the net-supporting rod and a horizontal plane is adjustable, thereby varying an aperture size of an upward opening formed by the flexible net around the net-supporting rod, and the included angle θ is an acute angle.

7. The basketball return device according to claim 1, wherein the fixing plate is further provided with a mounting hole, the flexible net is provided with a plurality of mounting straps and a plurality of mounting sleeves; the mounting sleeves are removably sleeved over the free end, and at least a part of the mounting straps are detachably secured in the mounting hole.

8. The basketball return device according to claim 1, wherein the net-supporting rod is a telescopic rod.

9. The basketball return device according to claim 1, further comprising a connecting element, wherein the mounting frame and the main frame are fixedly connected via the connecting element.

10. The basketball return device according to claim 1, wherein the main frame is further provided with moving wheels, the mounting plate is provided with a gripping opening, the gripping opening is configured to allow a palm to pass through and grip the mounting plate.

11. The basketball return device according to claim 1, wherein the mounting plate is provided with a basketball hoop cushion, and the basketball hoop cushion is configured to abut against a basketball hoop when the basketball return device is mounted on the basketball hoop support frame.

12. The basketball return device according to claim 1, wherein the mounting frame is provided with a backboard cushion, and the backboard cushion is configured to abut against a backboard when the basketball return device is mounted on the basketball hoop support frame.

13. The basketball return device according to claim 1, further comprising an auxiliary support element, wherein the auxiliary support element is detachably connected to the main frame, and when the auxiliary support element is connected to the main frame, the auxiliary support element is adapted to engage with a basketball stand support pole to enhance stability of the basketball return device mounted on the basketball hoop support frame of the basketball stand.

14. The basketball return device according to claim 1, wherein the basketball return mechanism comprises a locking unit, a fixing unit and a rotating unit; the fixing unit is configured to connect the basketball return mechanism to the main frame, the rotating unit is rotatably connected to the fixing unit, the rotating unit is configured to guide a return direction of the thrown basketball, and the locking unit is configured to lock the rotating unit along its rotational path; when the locking unit is in a locked state, the rotating unit cannot rotate relative to the fixing unit; and when the locking unit is in an unlocked state, the rotating unit can rotate relative to the fixing unit.

15. The basketball return device according to claim 11, wherein the basketball hoop cushion is slidably adjustable in a horizontal direction.

16. The basketball return device according to claim 12, wherein the backboard cushion is slidably adjustable in a vertical direction.

17. The basketball return device according to claim 12, wherein the auxiliary support element comprises an auxiliary support rod and a conforming support portion, the auxiliary support rod is fixedly connected to the conforming support portion, a rope passage hole is provided at an end of the conforming support portion, and the conforming support portion exhibits elastic deformability.

* * * * *